US006131907A

United States Patent [19]

Nucifora et al.

[11] Patent Number: 6,131,907

[45] **Date of Patent: *Oct. 17, 2000**

[54] METHOD FOR PLAYING A POKER-LIKE GAME

[76] Inventors: Patrick M. Nucifora; Thomas T. Gaytan, both of 22 S. Monroe Ave., Margate, N.J. 08402

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,728

[22] Filed: Jul. 14, 1997

[51] Int. Cl.[7] ..... A63F 1/00

[52] U.S. Cl. ..... 273/292

[58] Field of Search ..... 273/292, 274, 273/309; 463/13

[56] References Cited

U.S. PATENT DOCUMENTS

| | | | |
|---|---|---|---|
| 4,648,604 | 3/1987 | Horan | 273/292 |
| 4,836,553 | 6/1989 | Suttle et al. | 273/292 |
| 5,067,724 | 11/1991 | Rinkavage | 273/292 |
| 5,167,413 | 12/1992 | Fulton | 463/13 |
| 5,265,882 | 11/1993 | Malek | 273/292 |
| 5,288,081 | 2/1994 | Breeding | 273/292 |
| 5,322,295 | 6/1994 | Cabot et al. | 273/292 |
| 5,356,140 | 10/1994 | Dabrowski et al. | 463/12 |
| 5,382,025 | 1/1995 | Sklansky et al. | 273/292 |
| 5,411,268 | 5/1995 | Nelson et al. | 273/292 |
| 5,417,430 | 5/1995 | Breeding | 273/292 |
| 5,437,462 | 8/1995 | Breeding | 273/292 |
| 5,489,101 | 2/1996 | Moody | 273/292 |
| 5,544,892 | 8/1996 | Breeding | 273/292 |
| 5,573,249 | 11/1996 | Johnson | 273/292 |

OTHER PUBLICATIONS

"Stud Poker" and "Pig Stud Poker", Scarne's Encyclopedia Of Games, Harper & Row Publishers, pp. 33–37, 40, 41, Dec. 1973.

*Primary Examiner*—Benjamin H. Layno
*Attorney, Agent, or Firm*—Quirk & Tratos

[57] ABSTRACT

When played as a casino table game, the poker-type game of the present invention consists of a dealer and from one to six players and is played with a standard 52 card deck. After each player places an ante wager, the dealer deals three cards face down to each player. Each player then either folds and loses his bet or stays by placing a second wagering bet. A fourth face down card is then dealt to each player who either folds or places an additional raise bet. A fifth face-up card is then dealt to each remaining player. Losing hands are locked-up and winning hands are paid by the dealer according to the odds listed in a payout table. The object of the game is for a player to form a five card poker hand that has the highest possible poker hand ranking. The electronic version of the game is played in essentially the same manner except that only one hand is dealt. After the player inserts a coin or otherwise places his ante wager, three cards are dealt face up. The player then decides whether to fold or place a second wager for a fourth card. Again, the player decides whether to fold or place a double raise wager for his fifth card. If, after receiving the fifth card, the player has a winning hand, he is paid based on a payout table or he is determined to be a loser and all wages are forfeited.

3 Claims, 1 Drawing Sheet

METHOD FOR PLAYING A POKER-LIKE GAME

BACKGROUND OF THE INVENTION

The present invention is directed toward a method and apparatus for playing a poker-like card game and more particularly toward a new poker-like card game for use in a casino. The game may be designed as a table game or could be incorporated into an electronic poker machine.

As a leisure time activity, poker and other card games have fascinated the public for a very long time. Numerous variations of the game of poker including variations on stud poker and draw poker are well known to those in the art. The game is frequently played at home with three or more players betting against each other as to who has the best poker hand.

Poker-style card games have also been played in gaming casinos for many years. Normally gaming casinos provide segregated poker rooms in which a number of players gather around a poker table and play whatever type of poker game is being dealt at that table. The casino provides the dealers, handles the exchange of money for gaming chips and takes a percentage of each poker pot as the fee or "rake" for its services.

This type of live poker played in legalized gambling establishments, such as those in Atlantic City or Las Vegas, are not believed to be widely accepted by the average patron. Many may be afraid to play due to the reputation that card sharks are waiting for the unsuspecting player to come along. Such live games may, therefore, be intimidating to a novice or even an average poker player who may wish to participate.

One of the most popular live poker games played in many casinos is seven card stud. The game is well known to the average player and is relatively easy to understand and play. A significant problem with the game, however, particularly for the novice player, is that, even at low limits, the five rounds of betting and five raises can become extremely costly for a player to play even a single hand. This can be an expensive way for new players to learn the game.

Because of the foregoing, many novice players avoid playing live poker games in casinos. As a result, the current player base may consist of a group of regular players who dominate the games and often regard the newcomers as fish. These regular players may tend to hang out in poker rooms of particular casinos that may cater to them.

In many casinos, the above-described problems with live poker games have been addressed and attempts have been made to fill the void by providing a plurality of poker-style table games that are banked by the house and that are easily played and understood. Games that have achieved some substantial popularity in this regard are Caribbean Stud Poker and Let It Ride. A house-banked game is a game in which the gaming establishment pays all winning hands and collects all losing hands. Many of these games may also feature progressive jackpots that have proved to be very popular with players of all types. Because these games are structured as house-banked games, the gaming regulations in many jurisdictions do not permit the same.

As pointed out above, conventional well known forms of poker are not widely accepted by the average gaming patron. Such players do, however, seem to enjoy playing poker-style table games. The poker-style card game of the present invention has been created as a house-banked table game to be played in those jurisdictions which allow such games and is believed to fill a need for the novice, average or even expert poker player.

Additionally, with the advent of computer electronics, one player poker games played on electronic gaming machines have also become quite popular. The most popular of these games is five card draw poker wherein the player attempts to achieve a high ranking poker hand from his initially dealt five cards and any draw replacement cards. A payout table is provided that pays the player various multiples of his wager depending on the rank of poker hand that he has achieved.

Although five card draw poker is the most popular electronic video poker game, many other variations of poker have also been proposed in the electronic form. These include Joker's Wild, Deuces Wild and five and seven card stud. Each has its unique payout table reflecting the relative odds of achieving various poker hand rankings.

Although electronic poker machines are less intimidating than live poker games thereby making them more attractive to the novice player, they sometimes can become rather boring to many players since there is no social interaction. Furthermore, most electronic poker games are essentially straight well-known types of poker and have no variety. A player makes a single bet before the game begins and either wins or loses based on the single bet.

SUMMARY OF THE INVENTION

The present invention is designed to overcome the deficiencies of the prior art described above and to provide a novel poker-style card game that can be played as a house-banked game at a gaming table or in an electronic form as a video poker game. The game of the present invention is relatively simple and straightforward so that a novice player will not be intimidated but is sufficiently challenging and interesting so that an expert player will also enjoy the same.

The object of the game is for a player to form a five card poker hand that has the highest possible poker hand ranking. The ranking used is essentially the conventional poker hand rankings: royal flush, five of a kind, straight flush, four of a kind, full house, flush, straight, three of a kind, two pair and a single pair. Variations, however, can be included depending on the number, if any, of cards that may be wild.

When played as a table game, all players play against the house and not against each other. Preferably, the game consists of a dealer and from one to six players and is played with a standard 52 card deck. In the preferred form of the game, all deuces are wild. Each player places an ante wager and the dealer then deals three cards face down to each player. Each player then either folds or stays by placing a second wagering bet. A fourth face down card is then dealt to each player who either folds or places an additional raise bet. A fifth face-up card is then dealt to each remaining player. Losing hands are locked-up and winning hands are paid by the dealer according to the odds listed in a payout table.

The electronic version of the game is played in essentially the same manner except that only one hand is dealt. After the player inserts a coin or otherwise places his ante wager, three cards are dealt face up. The player then decides whether to fold or place a second wager for a fourth card. Again, the player decides whether to fold or place a double raise wager for his fifth card. If, after receiving the fifth card, the player has a winning hand, he is paid based on a payout table or he is determined to be a loser and all wagers are forfeited.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENTS

Figure 1:
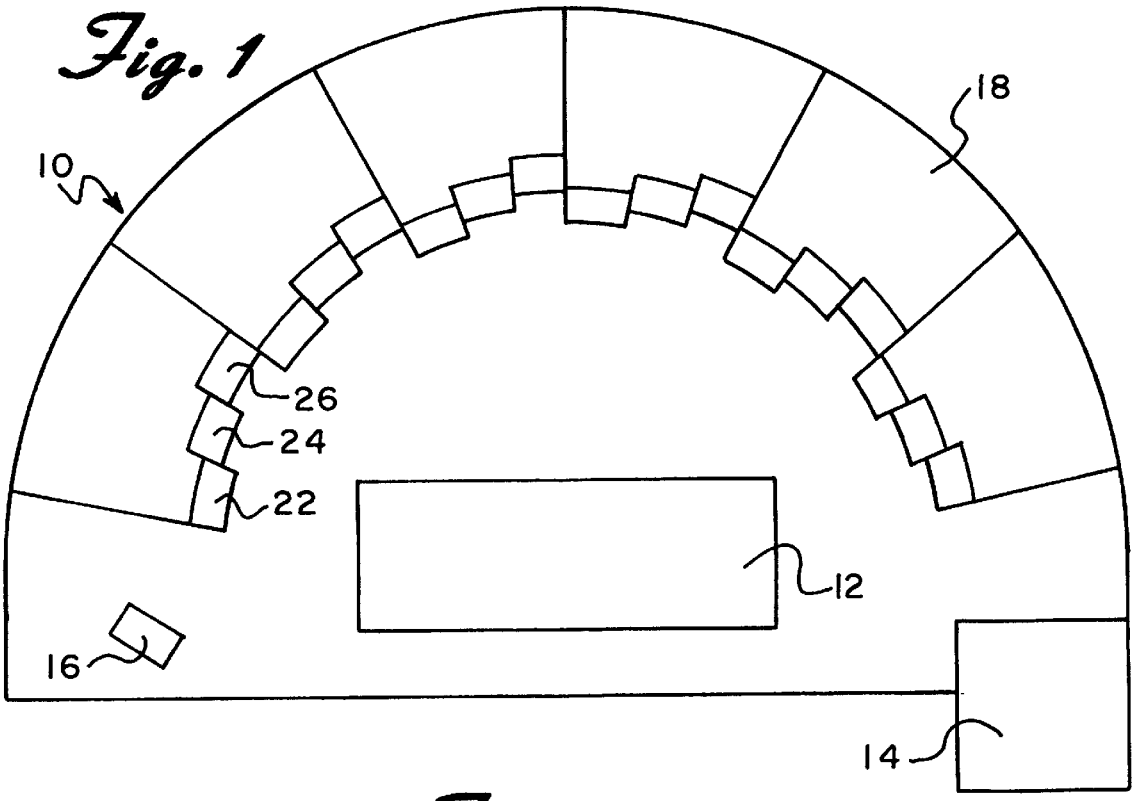
FIG. 1 is a schematic representation of a gaming table layout arranged in accordance with the principles of the present invention and on which the game of the invention may be played.

Referring now to the drawings in detail wherein like reference numerals have been used in the two figures to designate like elements, there is shown in FIG. 1 a gaming table layout designated generally as 10 and which is particularly suitable for playing the poker-style game of the present invention. The layout 10 is formed on a table similar to that used for black jack, Caribbean Stud Poker, Let It Ride and the like. The table includes a dealer's area with a chip rack 12, a card shoe or a shuffling machine 14 and a discard tray 16. The table layout 10 also includes a number of player spots or areas 18. In the preferred embodiment of the invention shown in FIG. 1, there are six player areas 18. As will be appreciated by those skilled in the art, however, the actual number of player areas can be varied according to the desires of the house. Furthermore, and as will also be readily apparent to those skilled in the art, while the table layout 10 may include six player areas 18, it is not necessary that all of them be utilized when the game is being played.

Figure 2:
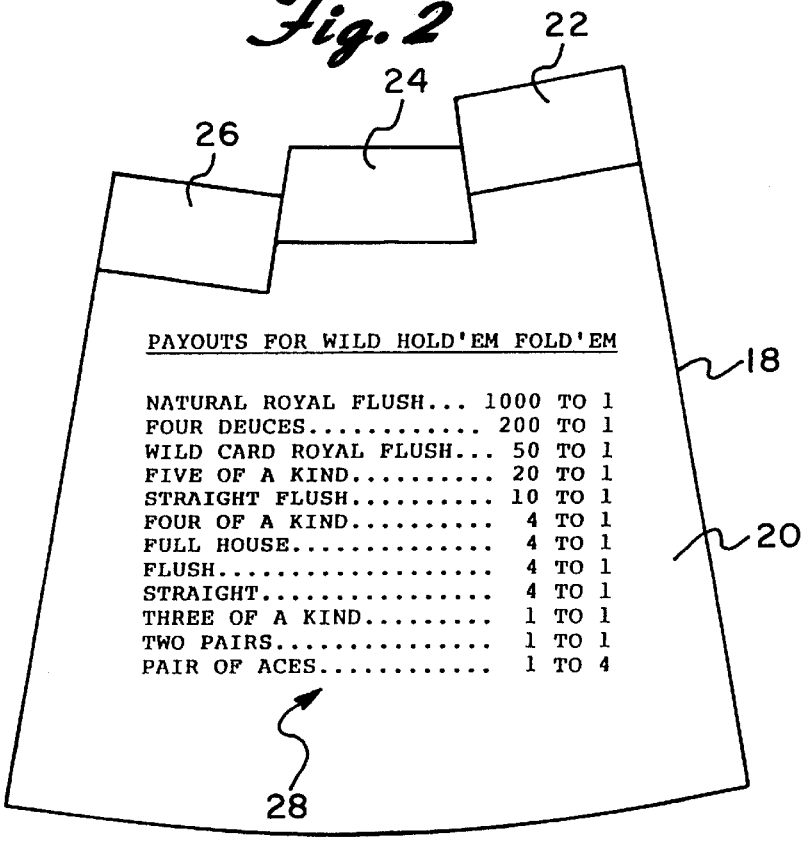
FIG. 2 is a more detailed representation of one of the individual player spots shown in FIG. 1.

The details of each of the playing areas 18 are illustrated in FIG. 2. Each player area 18 includes a large box 20 and three smaller boxes 22, 24 and 26 at the upper portion of the larger box 20. The smaller boxes 22, 24 and 26 are arranged side-by-side and preferably in a staggered configuration, as shown. Furthermore, the smaller boxes 22, 24 and 26 are arranged at the end of the area 18 closest to the dealer.

The larger boxes 20 of each of the player areas 18 are of sufficient size to enable a dealer to place five playing cards therein in a side-by-side arrangement. Preferably, a payout table or schedule 28 may also be printed on the game layout surface 10 within each of the larger boxes 20 of the player areas 18.

The smaller boxes 22, 24 and 26 are of sufficient size to allow gaining chips to be placed therein. The boxes 22, 24 and 26 are, of course, the places where each of the players will place his or her bets and these may be marked with the terms "Ante," "Bef" and "Raise," respectively, as indicated in FIG. 2. The meaning and significance of these terms in connection with the game of the present invention will become apparent hereinafter.

The poker-type game of the present invention is played essentially in the following manner. Initially, each player places a first bet in the Ante box 22. The amount of the first or ante wager must be at least one unit but may be multiples of that unit. That is, if the table is designated to be a $5 table, the first bet must be a $5 bet. If desired, however, the rules could be revised so as to allow for multiples of the $5 bet or possibly any amount above the $5 bet such as $7 or $8 or the like.

After each player has placed their ante wager, the dealer deals three cards to each player, face down. This can be done either by dealing one card to each player and then a second or third card to each player or by dealing three cards directly to each player. Preferably, the players should not be permitted to touch their cards until the dealer finishes dealing and signals them that it is okay. After a player has been dealt three cards, he or she is permitted to either fold or continue to play. Preferably, the dealer determines this one player at a time beginning at the left and rotating clockwise. If a player wishes to continue to play, he or she must place an additional bet wager in area 24. In the preferred form of the game, this bet wager must be equal to the amount of the ante wager. Obviously, however, the rules could be varied to allow different amounts to be wagered at this point. A player folds by not placing a wager bet and the dealer collects the player's cards and places them in the discard tray 16. Preferably, this is done in a way so that the cards are not exposed. The dealer also locks up the player's bet by collecting the chips and placing them in the rack 12.

After all bet wagers are placed and all folded hands are collected, the dealer deals a fourth card face down to each of the remaining players. Again, beginning from left to right, each player is given the option of either continuing to play or folding. If a player wishes to continue to play, he or she must place an additional wager in the raise area 26. In the preferred form of the invention, the raise wager must be twice the amount of the original ante or bet wager. Again, however, the rules may be varied to allow different amounts to be bet at this time. Any player who does not wish to continue to play, folds. The dealer collects all folded cards without exposing them to any of the other players and also locks up the bet and ante wagers of those players who have folded.

The dealer then deals a fifth card face up to each of the remaining players. Thereafter, the dealer or each player exposes the four down cards by turning them up and the dealer assesses each player's hand. Preferably, this is done starting at the right and moving counterclockwise. Each player's hand is assessed by comparing the same to the payout chart or table 28. If the player's hand does not include at least, for example, a pair of aces as indicated on the table 28, it is a losing hand. In such case, the cards and wagers are locked up. Winning hands, however, remain on the table.

Again, preferably starting from the right and moving counterclockwise, the dealer will pay each winning hand based on the payout table 28. After each player is paid, that player's cards are locked up.

In the preferred form of the invention, all deuces are wild. It should be readily apparent, however, that it is also possible to play the game of the present invention utilizing no wild cards or by designating other cards as being wild either in addition to or in lieu of deuces. Obviously, however, the payout table 28 would have to be modified based on the number of designated wild cards.

In most poker-type games, cards are dealt down so that each player cannot see the other player's hand. This is, of course, required since each player is playing against the other players and the object is to obtain a hand which is better than the other hands (or at least to pretend or bluff that one's hand is better than all others). In the game of the present invention, the players are playing against fixed preselected rankings and not against each other. However, the payout odds set forth in the table 28 are based, at least in part, on the probability of a player staying in the game and ultimately losing or dropping out early. The house, therefore, would be at a distinct disadvantage if each player were able to see all of the cards of the other players. This would allow a player to have a great deal more information concerning the probability as to whether he would ultimately have a winning hand and if the probability were not significant, he would fold early. The house would, therefore, lose the revenues that otherwise would be created by the player staying in and then ultimately losing. It is primarily for this reason that the first four cards are dealt down and that the players not be permitted to share information with other players.

In the electronic or video slot version of the invention, there would preferably be only one player's hand. After making a first or ante bet, the player would be dealt three cards that would be exposed. In accordance with the rules described above, the player would then have the choice of either folding and losing his or her ante bet or placing a second wager bet. If a wager bet were placed (which can be done by inserting more coins or applying more credits or the like), a fourth card is dealt or turned over. Again, and in accordance with the rules described above, the player would have the choice of either folding or placing a double raise bet. After a raise bet is placed, the fifth and final card is either dealt to the player or turned over and the machine will determine whether the player has won or lost in accordance with a payout table similar to table 28. If the player loses, the game is over. If, however, a player has won, he or she will be paid the amount set forth in the payout table.

Although the invention has been described primarily with respect to use in a casino, it could also be adapted for purely recreational use. For example, the game could be incorporated into a video computer game (such as for use with Nintendo, Sega or the like) that can be played on a computer monitor or television screen. This could be designed for either one or multiple players. Similarly, a hand held electronic game could be designed which similarly could be for one or multiple players. In any case, the game would be played substantially as described above.

The present invention may be embodied in other specific forms without departing from the spirit or essential attributes thereof and accordingly reference should be made to the appended claims rather than to the foregoing specification as indicating the scope of the invention.

We claim:

1. A method for at least one player to play a live, house banked, five card stud poker-type game utilizing a deck of playing cards and having a dealer representing the house playing against at least one player consisting essentially of the steps of:

before receiving any cards, the player placing a first ante bet;

the dealer dealing three cards face down to each player and allowing each player to view the faces of said three cards;

each player, as a sole mandatory option, either folding, in which case the player loses his first ante bet and is out of the game, or placing a second bet of a predetermined amount;

the dealer dealing a fourth card face down to each player who has placed a second bet and allowing each player to view the face down fourth card;

each player, as a sole mandatory option, either folding in which case the player loses his first and second bets or said player placing a third bet of a second predetermined amount;

the dealer dealing a fifth card face up to each player who has placed a third bet to conclude play of the hand and complete the player's hand;

thereafter, without additional play, comparing each remaining player's five card completed hand to a predetermined ranking of hands;

each remaining player forfeiting his bets if the comparison does not result in the player's cards achieving at least a predetermined rank or the dealer paying each player at predetermined odds based upon his bets if said comparison shows that the player's hand has achieved a predetermined rank.

2. The method of claim 1 wherein said first and second bets are of equal amounts.

3. The method of claim 2 wherein said third bet is twice the amount of said first or second bet.

* * * * *